US006108830A

United States Patent [19]

Schmitt

[11] Patent Number: 6,108,830

[45] Date of Patent: Aug. 29, 2000

[54] SAFETY HANDHOLD/ACCESSORY SUPPORT SHOWER VALVE ATTACHMENT

[76] Inventor: Louis Phillip Schmitt, 2500 E. Las Olas Blvd. #302, Fort Lauderdale, Fla. 33301

[21] Appl. No.: 09/323,454

[22] Filed: Jun. 1, 1999

[51] Int. Cl.[7] ..... A47K 3/12

[52] U.S. Cl. ..... 4/576.1; 4/559

[58] Field of Search ..... 4/559, 576.1, 577.1, 4/584, 605

[56] References Cited

U.S. PATENT DOCUMENTS

| | | | |
|---|---|---|---|
| 4,228,552 | 10/1980 | Weaver, Jr. | 4/576.1 X |
| 4,457,031 | 7/1984 | Moore | 4/605 X |
| 4,548,340 | 10/1985 | Messer | 4/559 X |

OTHER PUBLICATIONS

Trayco, "Winston Tub Surround", 2 pgs. Oct. 1988.

*Primary Examiner*—Robert M. Fetsuga
*Attorney, Agent, or Firm*—Alvin S. Blum

[57] ABSTRACT

An attachment for a shower valve assembly provides at least one secure handhold. It may optionally also provide at least one hook for a washcloth, a soap dish and/or a bottle holder for holding items used while showering. The attachment includes a broad base plate that is fastened to the shower valve assembly by screw fasteners in a manner similar to the usual face plate that covers the hole in the wall behind which rests the valve assembly. The handhold and other accessories are securely attached to the base plate. Because the valve assembly is held securely in place by the three or four pipes to which it is attached, all forces on the handhold are transmitted to the pipes, thus ensuring a very firm and secure connection. The attachment is easily mounted with only a screwdriver and no special skills. The original face plate may be mounted over the base plate before the control knob is installed, or the base plate may be constructed to also serve the covering function of the face plate.

18 Claims, 1 Drawing Sheet

SAFETY HANDHOLD/ACCESSORY SUPPORT SHOWER VALVE ATTACHMENT

BACKGROUND OF THE INVENTION

The present invention relates generally to supports and brackets and more particularly to handholds and item support brackets and hooks that attach to a wall mounted shower valve. When entering, leaving and using a shower enclosure, it is useful for comfort and safety to have a handhold at an elevation that is easily reached by the standing user. It is also useful to have a holder for soap, shampoo, washclothes and the like at a similar elevation. It is well known in the prior art to provide a hand grip, handle or handhold, often in combination with a soap dish, that is mounted on the wall adjacent to the shower valve assembly wall. This may take the form of a monolithic ceramic piece matching the ceramic tile. It is cemented in place by the tile setter. Alternatively, a handhold and or soap dish may be mounted with anchor bolts. Because the wall supporting the shower valve is cut out for the valve plumbing, the handhold/soap dish is generally not mounted on that wall, but on an adjacent wall. Such handholds, whether mounted to the wall by tile cement or anchor bolts, tend to come loose after a period of use and may detach in a dangerous situation. It is now common to provide complete shower stalls or combination shower stalls and bathtubs that are molded in one piece, complete with smooth walls. The plastic molding processes employed do not permit very useful integral soap dishes and/or handholds. Mounting such devices permanently and securely onto these molded assemblies is difficult and labor intensive. Mounting onto existing tile walls is especially difficult.

SUMMARY OF THE INVENTION

It is, accordingly, an object of the present invention to provide a handhold, hand grip or handle, and support for accessories such as soap, shampoo, and washclothes that is easily applied without special tools or skills. It is another object that the device mount very securely and permanently in place, while being readily removable without damage to the shower stall or walls for valve maintenance. It is yet another object that the device present a pleasing appearance when installed.

The device of the invention comprises a thin flat base plate upon which are mounted at least one handhold, a soap dish, and at least one hook for hanging a mesh bag of items or a washcloth. Optionally a bottle holder may also be mounted on the base plate to support a shampoo or the like. The base plate is secured to the valve assembly by screw fasteners that ordinarily secure a face plate to the valve assembly. The fasteners are covered by the control knob. The base plate may take the place of the face plate or be interposed between the face plate and the wall. When the base plate is made of transparent material, the face plate must be used to obscure the valve assembly.

These and other objects, features and advantages of the invention will become more apparent when the detailed description is studied in conjunction with the drawings, in which like reference characters indicate like elements in the various drawing figures.

DETAILED DESCRIPTION OF PREFERRED EMBODIMENTS

Figure 1:
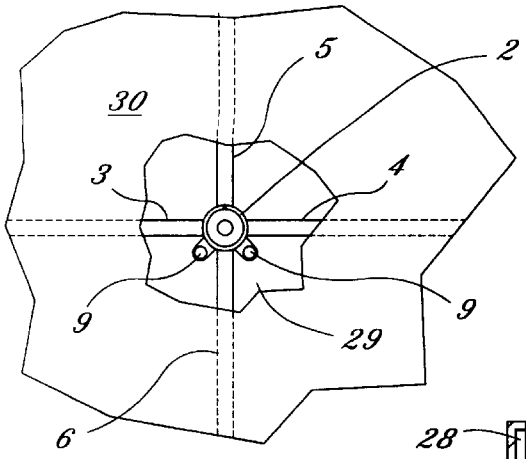
FIG. 1 Prior Art
FIG. 1 is a front elevation of a shower valve assembly of the prior art installed in a wall.
Figure 2:
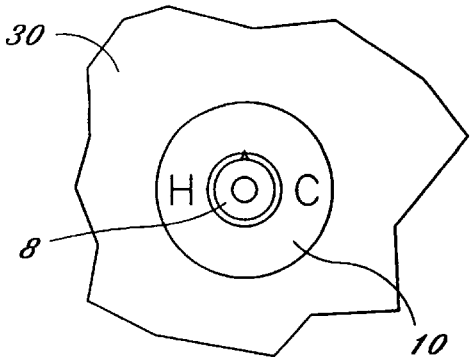
FIG. 2 Prior Art
FIG. 2 is a front elevation of the shower valve assembly of FIG. 1 with face plate and control knob of the prior art in place.
Figure 3:
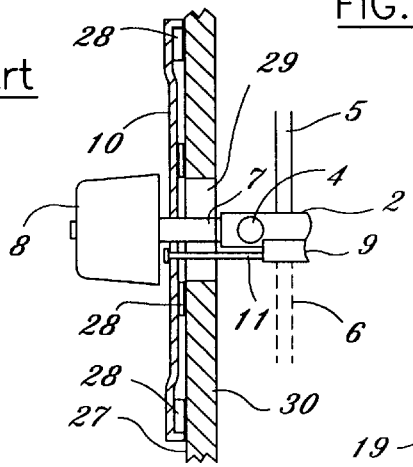
FIG. 3 Prior Art
FIG. 3 is a side elevation view of the assembly of FIG. 2, partially in section.

Referring now first to FIGS. 1–3, it is well known in the prior art to provide a shower valve assembly 2 mounted behind a tile, plastic, or plaster wall 30 that is connected to hot water pipe 3, cold water pipe 4, mixed water outlet pipe 5 directed upward to a shower head (not shown), and, optionally, to a mixed water outlet pipe 6 directed downward to a bathtub spout (not shown). The opening 29 in the wall 30 providing access to the valve assembly is generally covered by a decorative face plate 10 with resilient gaskets 28 that engages the outer wall surface 27, sealing off the opening. The face plate 10 is held securely against the wall by screw fasteners 11 that are received in threaded fastener receiving elements 9 attached to the valve assembly. The valve is operated by rotation of valve control shaft 7. Water control knob 8 is affixed to the shaft and in some cases may be wide enough to cover the screw fasteners 11. In other applications, a smaller knob is used and the fasteners are exposed, but they are chrome plated for enhanced appearance. The knob and face plate are easily removed and replaced when valve maintenance is required.

Figure 4:
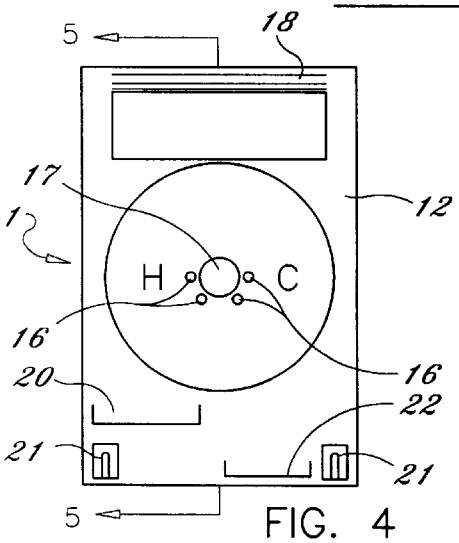
FIG. 4 is a front elevation view of the attachment of the invention.
Figure 5:
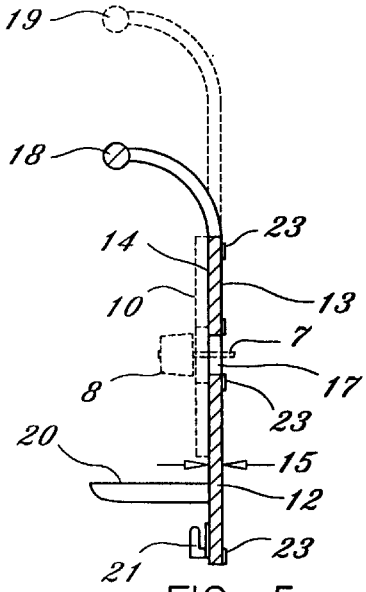
FIG. 5 is a sectional view of the attachment of FIG. 4 taken through line 5–5, with a face plate and control knob shown in phantom.

Referring now to FIGS. 4 and 5, the attachment 1 of the invention makes it possible to provide at least one handhold 18, and, optionally, a soap dish 20, hooks 21, and/or a bottle holder 22 that may be fastened securely to the wall by an unskilled person using only a screwdriver. It requires no hole drilling, anchor bolts, or marring or defacing the walls. It is easily removed for maintenance. The attachment 1 comprises a broad base plate 12 having a flat rear face 13 with resilient gaskets 23 for sealing to the outer surface of the wall that completely covers the wall opening. A central aperture 17 permits passage of the valve control shaft 7 therethrough. Apertures 16 are provided for passage therethrough of one or more screw fasteners. Apertures may be provided at multiple locations to accommodate different valves, and are positioned so as to permit screw fasteners to engage the screw receiving elements 9 shown in FIGS. 1, 3.

Forces on the handhold are transmitted to the valve assembly, which is firmly supported by the three or four pipes within the wall. This is a very secure supporting mechanism, superior in many respects to the conventional anchor bolts or cement commonly employed in mounting handholds on shower walls. The base plate 12 may be opaque so that it replaces the face plate 10 of FIG. 2 in covering the wall opening. Alternatively, the distance 15 between the rear face 13 and the opposed front face 14 of the base plate 12 may be small enough to enable a face plate 10 (shown in phantom) to be interposed between the front face 14 of the base plate and the control knob 8 (shown in phantom) without interfering with operation of the valve. The attachment 1 may be optionally molded in one monolithic piece of transparent plastic to be used with any wall covering color and material, with the original face plate 10 covering the wall opening. When the shower valve is located low on the wall, as it often is to service both a bathtub and a shower head, a second handhold 19 may optionally be provided at a higher elevation and also connected to the base plate 12.

The above disclosed invention has a number of particular features which should preferably be employed in combination, although each is useful separately without departure from the scope of the invention. While I have shown and described the preferred embodiments of my invention, it will be understood that the invention may be embodied otherwise than herein specifically illustrated or described, and that certain changes in form and arrangement of parts and the specific manner of practicing the invention may be made within the underlying idea or principles of the invention.

What is claimed is:

1. An attachment for a shower valve assembly that has been mounted behind and within a wall, the shower valve assembly having a hot water pipe inlet, a cold water pipe inlet, at least one mixed water pipe outlet, at least one valve control shaft, at least one water control handle for mounting on the at least one valve control shaft, and fastener receiving means for receiving at least one fastener for securing a face plate to the shower valve assembly, the attachment comprising:

a broad base plate having a rear face for engaging the outer surface of the wall within which the assembly is mounted and an opposed front face spaced apart from the rear face by a distance sufficiently small to enable the base plate to be interposed between the valve assembly and the at least one water control handle without interfering with operation of the at least one handle, the base plate being provided with at least one fastener aperture to enable said at least one fastener to pass therethrough to said fastener receiving means for providing the means for securing said base plate to said wall and at least one shaft aperture for passage therethrough of said at least one valve control shaft;

at least one handhold connected to said base plate and extending outward therefrom away from said wall, said handhold and said base plate constructed for transmitting forces applied to said handhold to said inlet and outlet pipes through said at least one fastener;

a soap retaining member connected to said base plate; and at least one hook member connected to said base plate.

2. The attachment according to claim 1, in which said distance between said front and rear faces of said base plate is small enough to enable a face plate to be interposed between said base plate and said at least one handle without interfering with operation of said at least one handle.

3. The attachment according to claim 2 further comprising a bottle holder connected to said base plate.

4. The attachment according to claim 1 further comprising a bottle holder connected to said base plate.

5. The attachment according to claim 1 that has been molded in one monolithic piece.

6. The attachment according to claim 2 that has been molded in one monolithic piece.

7. An attachment for a shower valve assembly that has been mounted behind and within a wall, the shower valve assembly having a hot water pipe inlet, a cold water pipe inlet, at least one mixed water pipe outlet, at least one valve control shaft, at least one water control handle for mounting on the at least one valve control shaft, and fastener receiving means for receiving at least one fastener for securing a face plate to the shower valve assembly, the attachment comprising:

a broad base plate having a rear face for engaging the outer surface of the wall within which the assembly is mounted and an opposed front face spaced apart from the rear face by a distance sufficiently small to enable the base plate to be interposed between the valve assembly and the at least one water control handle without interfering with operation of the at least one handle, the base plate being provided with at least one fastener aperture to enable said at least one fastener to pass therethrough to said fastener receiving means for providing the means for securing said base plate to said wall and at least one shaft aperture for passage therethrough of said at least one valve control shaft; and at least one handhold connected to said base plate and extending outward therefrom away from said wall, said handhold and said base plate constructed for transmitting forces applied to said handhold to said inlet and outlet pipes through said at least one fastener.

8. The attachment according to claim 7, in which said distance between said front and rear faces of said base plate is small enough to enable a face plate to be interposed between said base plate and said at least one handle without interfering with operation of said at least one handle.

9. The attachment according to claim 8, further comprising a soap retaining member connected to said base plate.

10. The attachment according to claim 7 further comprising a soap retaining member connected to said base plate.

11. The attachment according to claim 7 that has been molded in one monolithic piece.

12. The attachment according to claim 8 that has been molded in one monolithic piece.

13. The attachment according to claim 7, further comprising at least one hook member connected to said base plate.

14. The attachment according to claim 8, further comprising at least one hook member connected to said base plate.

15. An attachment for a shower valve assembly that has been mounted at least partly behind and within a wall, the shower valve assembly having a hot water pipe inlet, a cold water pipe inlet, at least one mixed water pipe outlet, at least one valve control shaft, at least one water control handle for mounting on the at least one valve control shaft, and fastener receiving means for receiving at least one fastener for securing a face plate to the shower valve assembly, the attachment comprising:

a broad base plate having a rear face for engaging the outer surface of the wall within which the assembly is mounted and an opposed front face spaced apart from the rear face by a distance sufficiently small to enable the base plate to be interposed between the valve assembly and the at least one water control handle without interfering with operation of the at least one handle, the base plate being provided with at least one fastener aperture and at least one shaft aperture for passage therethrough of said at least one valve control shaft;

at least one threaded fastener for passing through said at least one fastener aperture for securely engaging said fastener receiving means and holding said base plate to said valve assembly; and at least one handhold connected to said base plate and extending outward therefrom away from said wall, said handhold said base plate and said at least one threaded fastener constructed for transmitting forces applied to said handhold to said inlet and outlet pipes.

16. The attachment according to claim 15 in which said distance between said front and rear faces of said base plate is small enough to enable a face plate to be interposed between said base plate and said at least one handle without interfering with operation of said at least one handle.

17. The attachment according to claim 16, further comprising a soap retaining member connected to said base plate.

18. The attachment according to claim 17, further comprising at least one hook member connected to said base plate.

* * * * *